US005385111A

United States Patent [19]

Schulze

[11] Patent Number: 5,385,111

[45] Date of Patent: Jan. 31, 1995

[54] ARRANGEMENT FOR THE DRIVE OF A WATERCRAFT, IN PARTICULAR FOR AN INFLATABLE BOAT

[75] Inventor: Manfred Schulze, Melle, Germany

[73] Assignee: Jetmarine AG, ZUG, Switzerland

[21] Appl. No.: 90,069

[22] PCT Filed: Dec. 10, 1992

[86] PCT No.: PCT/EP92/02853

§ 371 Date: Jul. 23, 1993

§ 102(e) Date: Jul. 23, 1993

[87] PCT Pub. No.: WO93/11994

PCT Pub. Date: Jun. 24, 1993

[30] Foreign Application Priority Data

Dec. 18, 1991 [DE] Germany ..... 4141815

[51] Int. Cl.[6] ..... B63B 7/08

[52] U.S. Cl. ..... 114/345; 440/38

[58] Field of Search ..... 440/38, 39, 40, 41, 440/42, 43, 1, 2; 114/345

[56] References Cited

U.S. PATENT DOCUMENTS 3,834,342 9/1974 Schoell ..... 440/38
3,840,319 10/1974 Rhoda ..... 440/38
3,942,464 3/1976 Schoell ..... 440/38
4,964,821 10/1990 Tafoya ..... 440/1
5,184,564 2/1993 Rubbins et al. ..... 114/345

FOREIGN PATENT DOCUMENTS 2017747 1/1972 Germany .
501161 3/1939 United Kingdom .
2032871 5/1980 United Kingdom .

*Primary Examiner*—Stephen P. Avila
*Attorney, Agent, or Firm*—McAulay Fisher Nissen Goldberg & Kiel

[57] ABSTRACT

A drive unit for a watercraft, in particular for an inflatable boat, with a motor unit and with a pump unit for the intake, acceleration and expulsion of water, which pump unit is in a driving connection with the motor unit via a power train, and with fastening members for detachably mounting the drive unit to a watercraft. The inboard motor unit and the outboard pump unit are connected with one another via supporting members which serve to support the motor unit, are fastened to a housing enclosing the pump unit and, together with the power train, penetrate a plate which is arranged between the two units, forms a front side of the housing and is detachably connected with the transom of the watercraft.

12 Claims, 2 Drawing Sheets

A

ARRANGEMENT FOR THE DRIVE OF A WATERCRAFT, IN PARTICULAR FOR AN INFLATABLE BOAT

BACKGROUND OF THE INVENTION a) Field of the Invention

The invention relates to an arrangement with a motor unit, with a pump unit which is in a driving connection with the motor unit and generates a water jet, and with fastening members for detachably mounting the arrangement to a watercraft, particularly an inflatable boat.

b) Background of the Related Art

It is known to produce hydraulic jet-drive mechanisms for watercraft as complete structural units, to arrange them on the suitably constructed watercraft and to couple them with a motor unit arranged in the watercraft (compare DE-OS 21 52 308).

However, for this purpose the watercraft must have a portion constructed as an inlet duct for the water which is to be sucked in so that boats of standard construction from conventional series manufacture are not suitable for mounting such drive arrangements. This is particularly true of inflatable boats which are produced from material which is pliable in bending and maintains its dimensional stability by means of enclosed air at above-atmospheric pressure and which have only a lower stern or transom produced from solid material, e.g. wood or metal.

For this reason, inflatable boats formerly had to be provided in particular with stern parts which were rigid in themselves and whose construction enabled the mounting and fastening of this stern part on the end of the hull of the inflatable boat (compare *Hobby,* 1974, page 10, "Hydro-Dyn").

Apart from the fact that they are expensive to produce, such stern parts are bulky and difficult to transport in view of their space requirement.

Based on the known construction of so-called Z-type drives in which the motor and screw are allocated to a common shaft housing and which can be mounted on the transom of a watercraft of any construction simply by means of a screw connection, the invention has the object of providing an arrangement for propelling a watercraft, particularly for an inflatable boat made from structural component parts occupying little space so as to economize on weight. This arrangement is constructed as a mount-on unit enabling a secure support of the motor unit and a pump which generates a water jet and whose construction and arrangement enable mounting by untrained water-sports enthusiasts.

This object is met according to the invention in that the motor unit and pump unit are allocated to the opposing surfaces of the front side of a housing which partially encloses at least the pump housing, the front side of the housing being penetrated by the driving connection between the motor unit and pump unit and by supporting members which are rigidly connected with the housing and serve to support the motor unit, and the front side of the housing is constructed as a fastening flange of the arrangement for mounting to the transom of the watercraft.

According to a further feature of the invention, the housing is made from plates which are detachably connected with one another and the supporting members are constructed as rods which are detachably fastened at the plates forming the opposing side faces of the housing, the supporting members enclosing an angle diverging from 90° with the front side of the housing penetrated by them.

According to a preferred embodiment form of the invention, the supporting members are arranged parallel to the power train between the motor unit and pump unit.

OBJECT AND SUMMARY OF THE INVENTION

A simple and space-saving construction of the arrangement and mounting thereof are achieved in that the arrangement according to the invention is constructed as a mount-on unit which is rigid in itself and has a mounting flange. Further, the construction, as a primary arrangement according to the invention ensures a rigid arrangement of the motor, pump and their power train members whose relative position also remains unchanged during rough operation over longer operating periods, which results in great benefits for driving operation particularly in watercraft, such as inflatable boats, which are flexibly yielding per se, i.e. only quasi-rigid. The position of the motor unit with respect to the pump unit is exactly defined by means of the supporting members arranged according to the invention so that a trouble-free transmission of power is also ensured. When transported by land, which is generally done in the collapsed state in the case of inflatable boats, the construction of the arrangement according to the invention likewise offers advantages, since it is produced from few structural component parts which can be screwed together and occupy little space in either assembled or disassembled state.

The invention is described in the following with reference to an embodiment example of the arrangement which is shown more or less schematically in the drawing.

DESCRIPTION OF THE PREFERRED EMBODIMENTS

Figure 1:
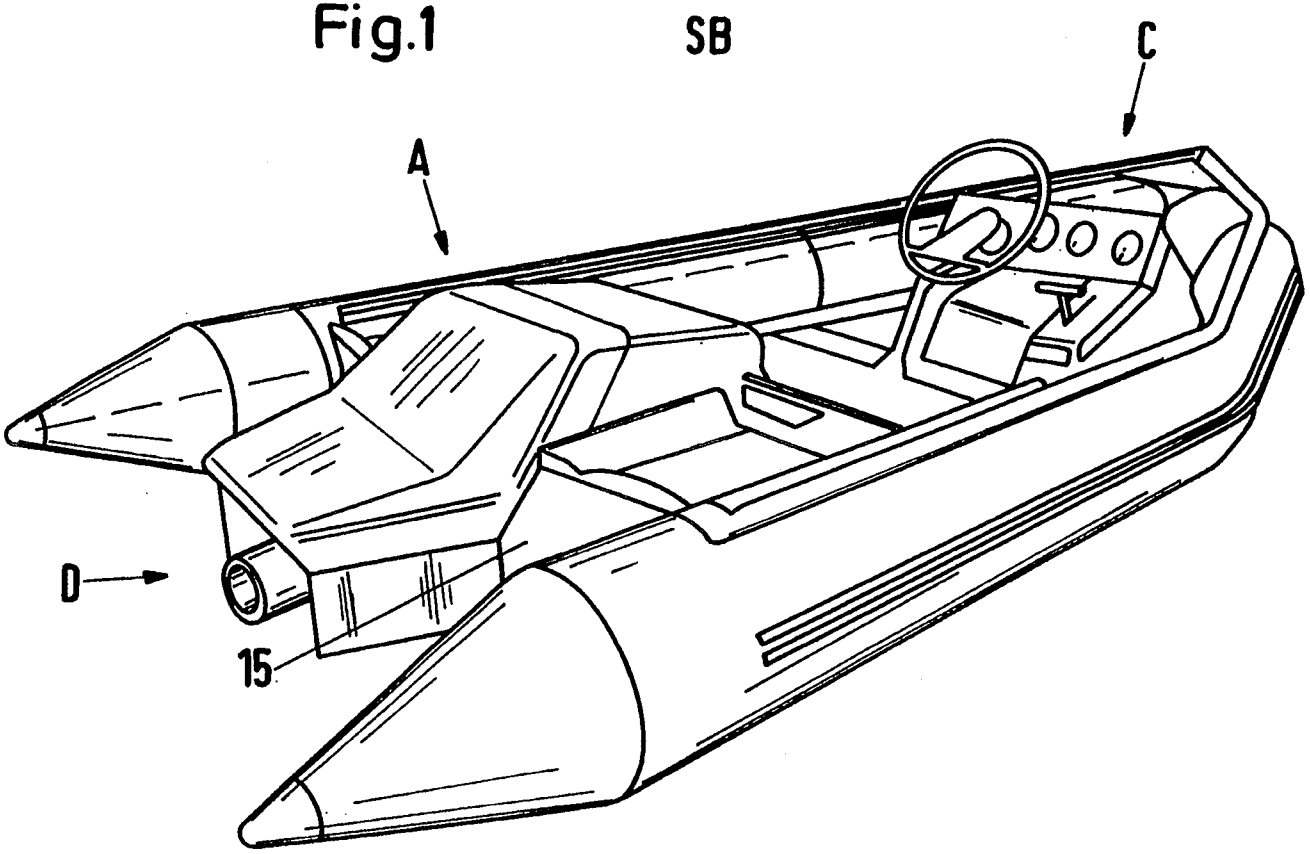
FIG. 1 shows a perspective view of an inflatable boat with mounted arrangement for generating propulsion.
Figure 2:
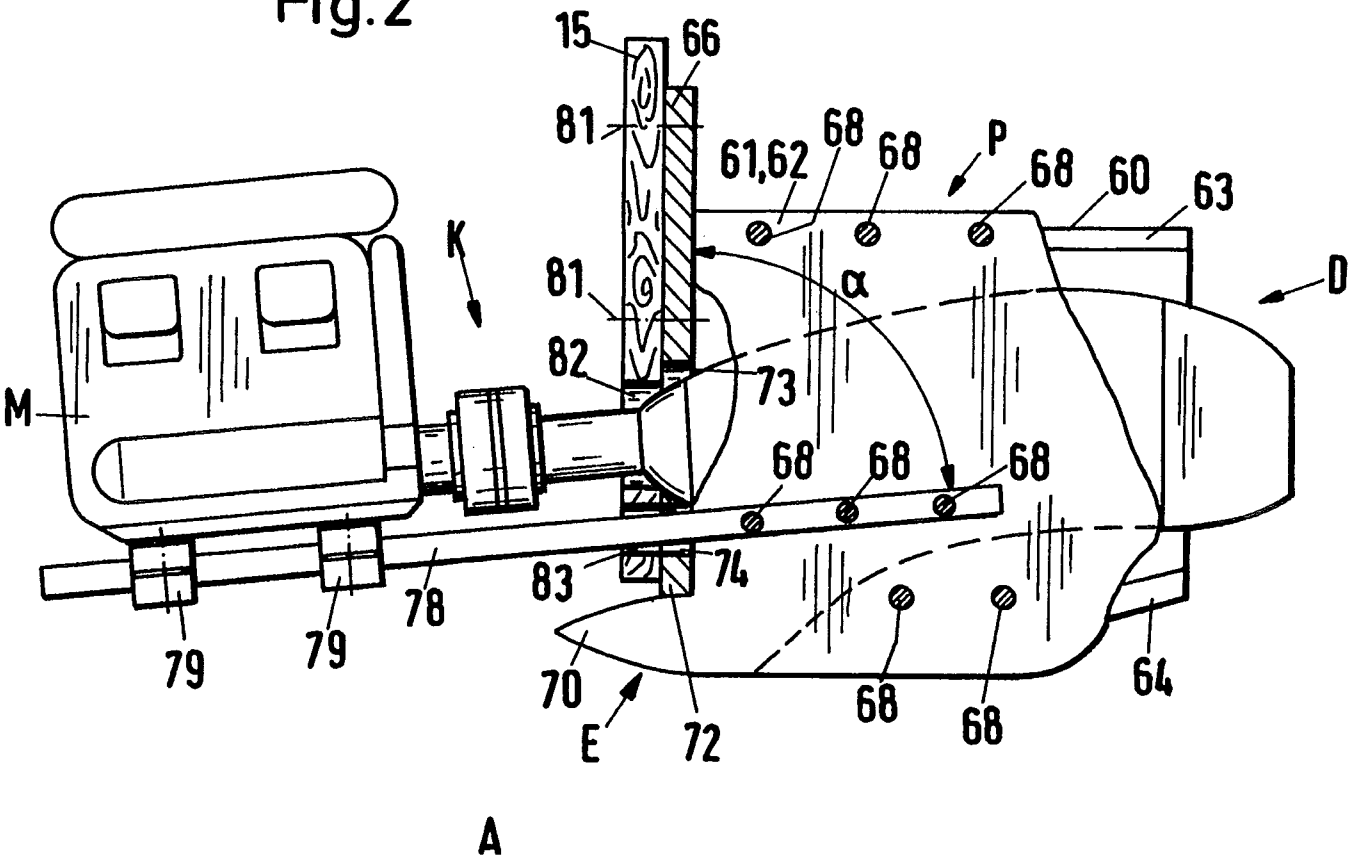
FIG. 2 shows a side view, partially in section, of the arrangement for generating propulsion for a watercraft, which arrangement is constructed as a mount-on unit.

An arrangement A for generating the desired propulsion in the form of a water-jet drive is detachably connected at the stern of an inflatable boat SB shown in FIG. 1 with cockpit C. As shown in FIG. 2, the arrangement A includes a motor unit M and a pump unit P which receives water via an indicated intake E, accelerates the water and expels it via a jet D. The motor and pump units M and P are in a driving connection with one another via a power train K.

As is also shown in FIG. 2, a housing 60 is associated with the pump unit P, encloses the latter at least partially and has five plates, namely two identical plates 61/62 which are located opposite one another and form the side faces of the housing, the upper and lower cover plates 63 and 64 which are arranged at right angles thereto, and a plate 66 which is arranged at right angles to one end side of the aforementioned plates 61 to 64 and forms the front side of the housing 60. All plate parts are screwed together by screws 68. The identical plates 61 and 62 forming the side faces have a runner-shaped projection 70 in each instance at their lower side with reference to FIG. 2, which projection 70 laterally encloses the inlet E shown in dashed lines in FIG. 2. The plate 66 forming the front side fits on the runner-shaped continuations 70 with its lower edge 72 and projects with its remaining three side edges over the space of the housing 60 enclosed by the plates 61, 62 and 63 as is clearly shown with respect to plate 63 in FIG. 2.

There is a central opening 73 in the lower third of the plate 66 forming the front side as well as two openings 74 in its lower region in the vicinity of the outer edges, which openings 74 are identical to one another. The central opening 73 of the three openings is penetrated by the power train K, i.e. the drive shaft of the arrangement, while the side openings 74 are penetrated in each instance by supporting members 78 which are constructed as rods and are rigidly but detachably connected by their ends adjacent to the housing 60 with the plates 61 and 62, respectively, forming the side faces of the housing, likewise by means of screw connections 68. The motor unit is rigidly but detachably fastened to the opposite ends of the supporting members 78 by commercially available clamping connections 79. The supporting members 78 enclose an angle $\alpha$ diverging from 90° with the front side 66 of the housing 60 penetrated by them in order to maintain the adjustment angle of the arrangement with respect to the watercraft necessary for the intake of water.

The plate 66 forming the front side of the housing 60 is simultaneously constructed as a fastening flange of the arrangement for attaching it to the transom 15 of the inflatable boat SB as is immediately evident from FIG. 2. For this purpose, the boat transom 15 likewise has openings 82 and 83 which correspond to the openings 73 and 74 in the plate 66 forming the front side. The fastening to the wooden or metal transom 15 is likewise effected by detachable screw connections 81.

While the foregoing description and drawings represent the preferred embodiments of the present invention, it will be obvious to those skilled in the art that various changes and modifications may be made therein without departing from the true spirit and scope of the present invention.

I claim:

1. A water jet propulsion arrangement comprising:

a motor unit;

a pump unit for generating a water jet, said pump unit being coupled to said motor unit by a drive connection;

a housing, said housing comprising a front side adapted to detachably mount said water jet propulsion arrangement to a transom of a flexible body watercraft, said housing at least partially enclosing said pump unit; and a supporting member directly connected to said housing for supporting said motor unit and adapted to stabilize the flexible body watercraft;

said front side being positioned between said motor unit and said pump unit and having through holes for receiving said drive connection and said supporting member.

2. The arrangement of claim 1 wherein the housing further comprises detachably connected top, bottom and opposing side walls, said supporting member being constructed as a pair of rods detachably fastened to the opposing side walls.

3. The arrangement according to claim 2, wherein the rods enclose an angle a diverging from 90° with said front side.

4. The arrangement according to claim 2 wherein the rods are arranged parallel to the drive connection between the motor unit and the pump unit.

5. The arrangement of claim 2 wherein said opposing sidewalls are constructed in the shape of runners with respect to said pump unit.

6. The arrangement of claim 2, wherein the top, bottom, front and opposing sidewalls are detachably connected with screws.

7. In a flexible body watercraft having a transom and a water jet propulsion unit attached to the transom including a motor unit, a pump unit for generating a water jet, the pump unit being coupled to the motor unit by a drive connection, the improvement comprising:

said water jet propulsion unit comprising:

a housing, said housing comprising a front side for detachably mounting said water jet propulsion arrangement to the transom of the flexible body watercraft, said housing at least partially enclosing said pump unit; and a supporting member directly connected to said housing for supporting said motor unit and for stabilizing the flexible body watercraft;

said front side being positioned between said motor unit and said pump unit and having through holes for receiving said drive connection and said supporting member.

8. The watercraft of claim 7 wherein the housing further comprises detachably connected top, bottom and opposing side walls, said supporting member being constructed as a pair of rods detachably fastened to the opposing side walls.

9. The watercraft according to claim 8, wherein the rods enclose an angle $\alpha$ diverging from 90° with said front side.

10. The watercraft of claim 8 wherein said opposing sidewalls are constructed in the shape of runners with respect to said pump unit.

11. The watercraft of claim 8, wherein the top, bottom, front and opposing sidewalls are detachably connected with screws.

12. The watercraft of claim 8, wherein the pair of rods are arranged parallel to the drive connection between the motor unit and the pump unit.

* * * * *